United States Patent [19]

Mukaiyama

[11] 4,023,344

[45] May 17, 1977

[54] AUTOMATICALLY CORRECTED ELECTRONIC TIMEPIECE

[75] Inventor: Fumiaki Mukaiyama, Suwa, Japan

[73] Assignee: Kabushiki Kaisha Suwa Seikosha, Tokyo, Japan

[22] Filed: Sept. 3, 1975

[21] Appl. No.: 610,022

[30] Foreign Application Priority Data

Sept. 3, 1975 Japan ..... 50-101248

[52] U.S. Cl. ..... 58/35 W; 58/23 R; 58/24 R

[51] Int. Cl.[2] ..... G04B 1/00

[58] Field of Search ..... 58/23 R, 24 R, 35 W, 58/85.5; 318/16

[56] References Cited

UNITED STATES PATENTS

| | | | |
|---|---|---|---|
| 3,566,600 | 3/1971 | Toshimura | 318/16 |
| 3,643,420 | 2/1972 | Hatdon | 58/24 R |
| 3,756,010 | 9/1973 | Kimura | 58/35 W |
| 3,881,310 | 5/1975 | Gerum | 58/35 W |

*Primary Examiner*—Gene Z. Rubinson

*Assistant Examiner*—Vit W. Miska

*Attorney, Agent, or Firm*—Blum, Moscovitz, Friedman & Kaplan

[57] ABSTRACT

An electronic timepiece assembly for automatically correcting the time displayed by a digital display electronic timepiece is provided. A first time standard electronic timepiece accurately counts present time, such standard electronic timepiece including a transmitter for selectively transmitting setting signals representative of the present time counted by the time standard timepiece. A further digital display electronic timepiece includes a timekeeping circuit for producing timekeeping signals and digital display means for displaying the present time in response to the timekeeping signals. The further electronic timepiece includes a receiver for selectively receiving the setting signals transmitted by the time standard electronic timepiece transmitter, and correction circuitry coupled to the timekeeping circuitry for automatically correcting the count of the timekeeping circuit in response to the setting signals selectively received by the receiver.

17 Claims, 7 Drawing Figures

AUTOMATICALLY CORRECTED ELECTRONIC TIMEPIECE

BACKGROUND OF THE INVENTION

This invention is directed to correcting digital display electronic timepieces and in particular to the use of correction signals transmitted by an accurate time standard electronic timepiece to automatically correct the time displayed by a digital display electronic timepiece.

Due to the small size of electronic digital display writstwatches, correction of the time displayed thereby has encountered considerable difficulties. The difficulties are usually related to the type of information displayed by the electronic timepiece.

For example, in a first type of electronic wristwatch wherein calendar information such as the day, date and month are displayed in addition to the hours, minutes and seconds, a considerable number of switches are required to effect the correction of the timekeeping circuitry associated with each digit of time displayed. Nevertheless, because of the small size of the electronic wristwatches, and the importance in sustaining the aesthetic effect thereof, it is desired to avoid the unsightly effect achieved by a large plurality of switches disposed on the electronic wristwatch. Moreover, because the correction of an electronic wristwatch having a large number of display digits requires the correction of many of such digits against a reference, the accuracy of such correction as well as the difficulty encountered in achieving same is an undesirable aspect in such digital display electronic wristwatches.

A second type of digital display electronic wristwatch having only four digits of time displayed, namely, hours and minutes are easier to correct, and requiring only two or four switches, provide benefits such as reduced cost, relative "simplicity" of correction and a fewer number of unsightly correction switches. However, such electronic wristwatches cannot be corrected to the accuracy to which same are capable of attaining. For example, in an electronic timepiece having only hours and minutes display digits, correction of the seconds counter, which counter produces signals which are not displayed is not possible. Further, although correction is "simpler" it is far from easy. Accordingly, it is desirable to effect correction of the time displayed by an electronic digital display wristwatch is a manner which avoids the above noted disadvantages.

SUMMARY OF THE INVENTION

Generally speaking, in accordance with the invention, an electronic timepiece assembly for automatically correcting the time displayed by a digital display electronic timepiece is provided. The electronic timepiece assembly includes a first time standard electronic timepiece adapted to accurately count present time, the standard electronic timepiece including a transmitter for selectively transmitting setting signals representative of the present time counted by the time standard. A further digital display electronic timepiece to be corrected includes an electronic timekeeping circuit for producing timekeeping signals and digital display elements for displaying present time in response to the timekeeping signals. The further electronic timepiece includes a receiver for selectively receiving the setting signals transmitted by the time standard electronic timepiece transmitter, and a correction circuit coupled to the timekeeping circuit for automatically correcting the count of the timekeeping circuit in response to the transmitted correction signals.

Accordingly, it is an object of this invention to avoid errors in correction of digital display electronic wristwatches occasioned by manual correction arrangements.

A further object of this invention is to provide an improved digital display electronic timepiece adapted to receive setting signals transmitted by an accurate time standard and be automatically corrected thereby.

Still a further object of this invention is to provide an improved electronic digital display timepiece correction arrangement wherein a highly accurate time standard is utilized to automatically correct the time display of digial display electronic wristwatches.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

DETAILED DESCRIPTION OF THE PREFERRED EMBODIMENTS

Figure 1:
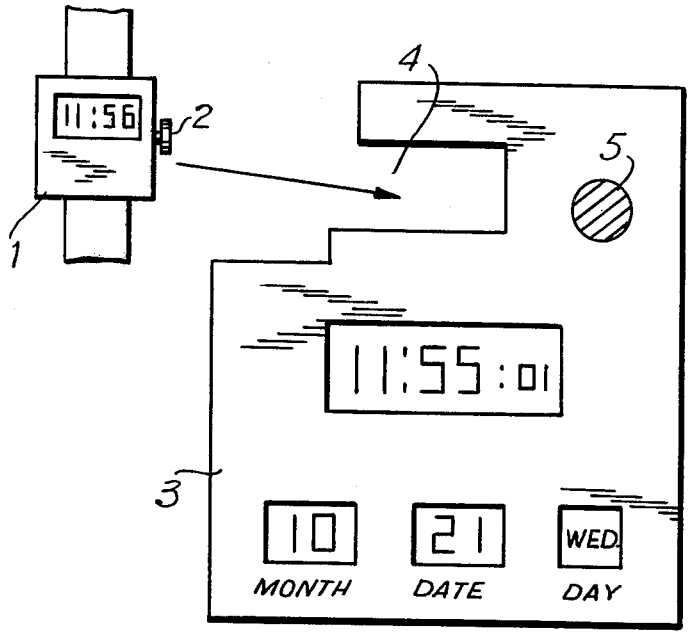
FIG. 1 is a perspective view of an electronic timepiece assembly for automatically correcting the time displayed by the digital display electronic wristwatch, constructed in accordance with the invention.

Reference is now made to FIG. 1, wherein an electronic timepiece assembly constructed in accordance with the instant invention is depicted. An electronic digital display wristwatch 1 is provided with a signal receiving portion, timekeeping circuitry and correction circuitry 2, and is described with greater particularity below. The electronic timepiece includes a switch 2 having two positions, a locking position in which the timepiece performs the usual timekeeping function, and an unlocking position in which the time is automatically corrected in accordance with the instant invention.

A time standard electronic timepiece is utilized to transmit signals to be received by the electronic wristwatch 1. The electronic timepiece 3 can be utilized as a digital display clock and is provided with highly accurate and precise timekeeping circuitry for providing timing information such as hours, minutes and seconds, and other digital display information such as the month and day. The time standard electronic timepiece 3 includes a recess 4, which recess is adapted to receive an electronic wristwatch 1 and position same proximate a transmitter disposed in the time standard electronic timepiece 3. The recess 4 is provided in order to insure the proximity of the receiver in the electronic timepiece 1 to the transmitter in the time standard electronic timepiece 3 to prevent any loss of signals during the transmission and to avoid interference from externally generated noise.

As depicted in FIG. 1, when the time displayed by the electronic wristwatch 1 differs from the time displayed by the time standard electronic timepiece 3, the switch 2 of the electronic wristwatch 1 is placed in an unlocked position, whereafter the electronic wristwatch is disposed in the transmitting recess 4 of the time standard electronic timepiece 3. Thereafter, actuating of push button 5 selectively effects transmission of coded signals representative of the count and hence time displayed by time standard electronic timepiece 3 to the electronic wristwatch 1 to automatically effect correction thereof. Thereafter the switch 2 is pushed to a locking position whereafter the electronic wristwatch 1 will display time in complete agreement with the time displayed by the time standard electronic timepiece provided the digits of the time standard electronic timepiece are not advanced during transmission.

Figure 2:
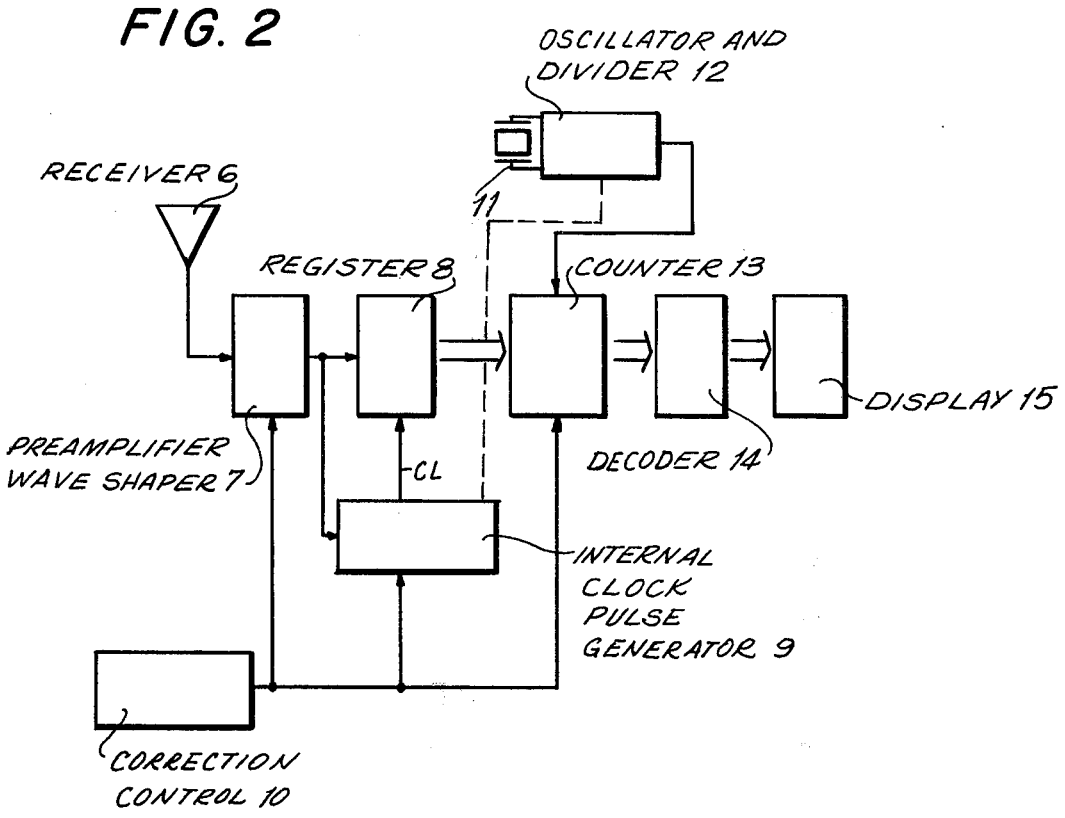
FIG. 2 is a block circuit diagram of an automatically correctable digital display electronic wristwatch constructed in accordance with the instant invention.

Reference is now made to FIG. 2 wherein a circuit diagram of the electronic wristwatch 1 of FIG. 1 is depicted. Reference is further made to FIGS. 4*a* and 4*b* and 5*a* and 5*b* wherein a detailed circuit diagram of a preferred embodiment of the invention illustrated in FIG. 2 is depicted.

The electronic wristwatch depicted in FIG. 2 includes conventional electronic timepiece circuitry for effecting display of present time. An oscillator-divider circuit 12 produces low frequency timekeeping signals having a period of 1 Hz, which signal is applied to counters 13, including seconds counters, minutes counters and hours counters.

The oscillator circuit includes a high frequency time standard such as a quartz crystal vibrator 11 and is further formed by a C-MOS inverter stage a feedback resister and capacitors. The oscillation circuit 16, produces a high frequency time standard signal having a frequency of $2^{15}$ Hz (32,768 Hz). The divider portion of the timekeeping circuitry includes 15 series-connected divider stages, which divider stages in response to the high frequency time standard signal applied to the first divider stage produce a 1 Hz signal. The 1 Hz signal is applied to the counters 13, which counters include the following series-connected counters: a one-tenth seconds counter; one-sixth 10 seconds counter; one-tenth minutes counter; one-sixth 10 minutes counter; and a 1/12 hours counter. The timekeeping signals produced by the minutes and hours counters are applied to seven segment-BCD decoders, which decoders comprise decoder circuit 14 and in turn are applied as decoded signals to the seven segment display elements comprising the digital display elements of the display 15. Accordingly, the timekeeping circuitry operates in a conventional mode when the switch 2 is in a locked position.

The setting signals transmitted by the time standard electronic timepiece 3 can be of any type transmission mode, the sole requirement for the receiver being that same be of a compatible receiving mode to receive such signals. Although BCD correction signals are the type utilized in the preferred embodiment depicted in FIGS. 4*a* and 4*b*, it is readily apparent that any digital or analog type transmission signals can be utilized in accordance with the instant invention. Among the transmission modes capable of being utilized in the instant invention, light, magnetism, electric pulses and sound waves are suitable. If, for example, light transmission is utilized, the receiver 6 would be a light responsive element, such light receiving element having considerable appeal when the development of solar batteries allow same to be easily and expensively incorporated into electronic timepiece. If the transmitted setting pulses are of sufficiently low frequency, a magnetism-detection coil can be utilized. When the transmission mode is electronic the low frequency date pulses are formed from tone bursts of high frequency signals. This correction method differs greatly from that utilized in radio timepieces. Finally, a sound transmission mode can be utilized by including a sub-miniature microphone capable of receiving supersonic waves from the time standard electronic timepiece is provided in the electronic wristwatch. The transmitted setting pulses would be pulses of supersonic waves.

Figure 3:
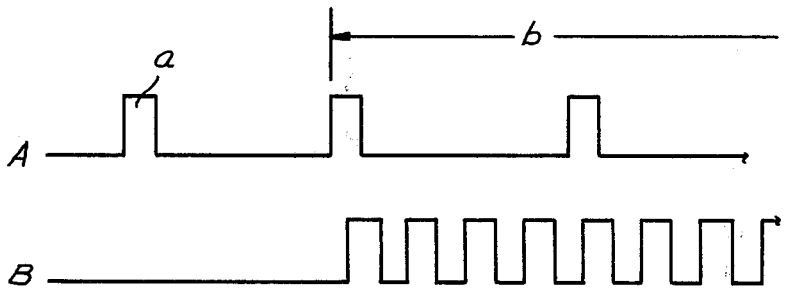
FIG. 3 is a timing diagram illustrating the operation of the digital display electronic wristwatch depicted in FIG. 2.
Figure 4A:
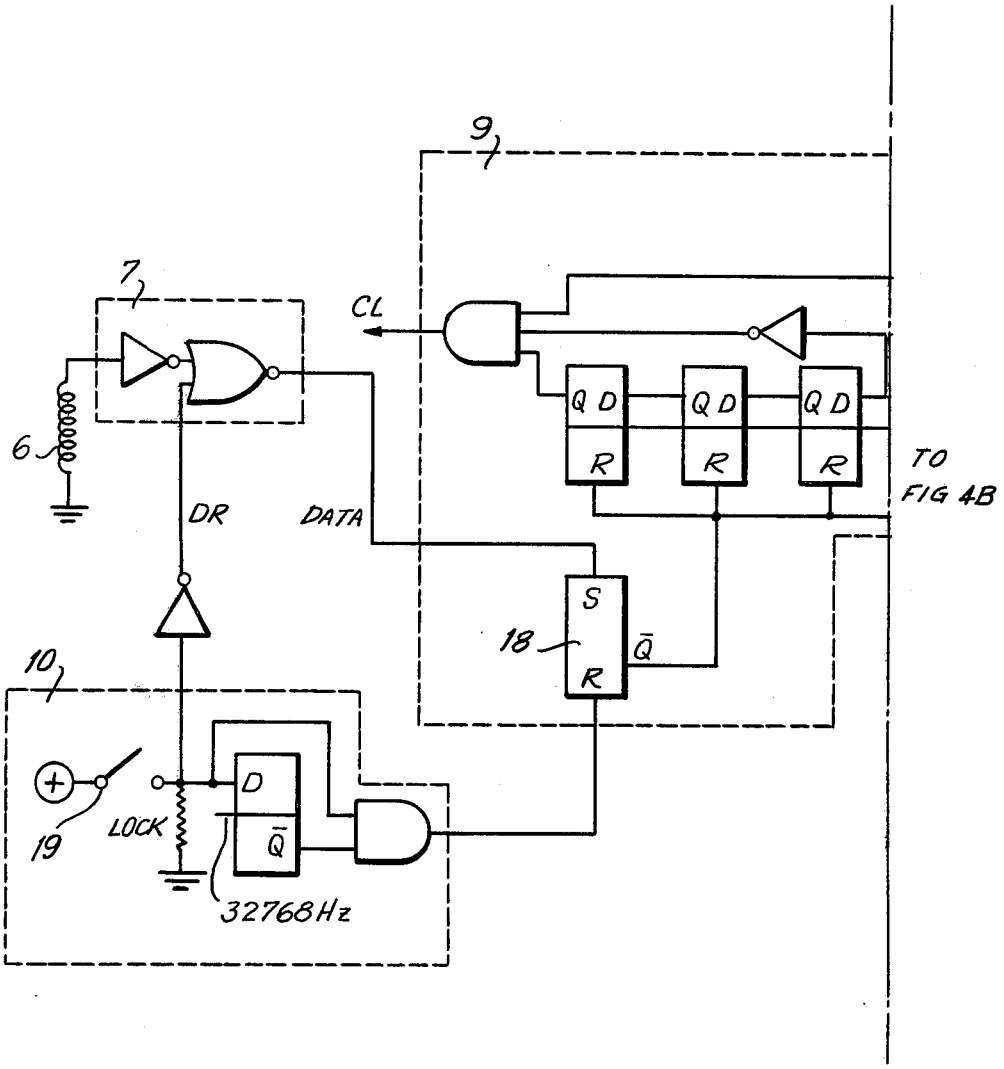
FIG. 4*a* and 4*b* are detailed circuit diagrams of a portion of the electronic wristwatch depicted in FIG. 2.
Figure 4B:
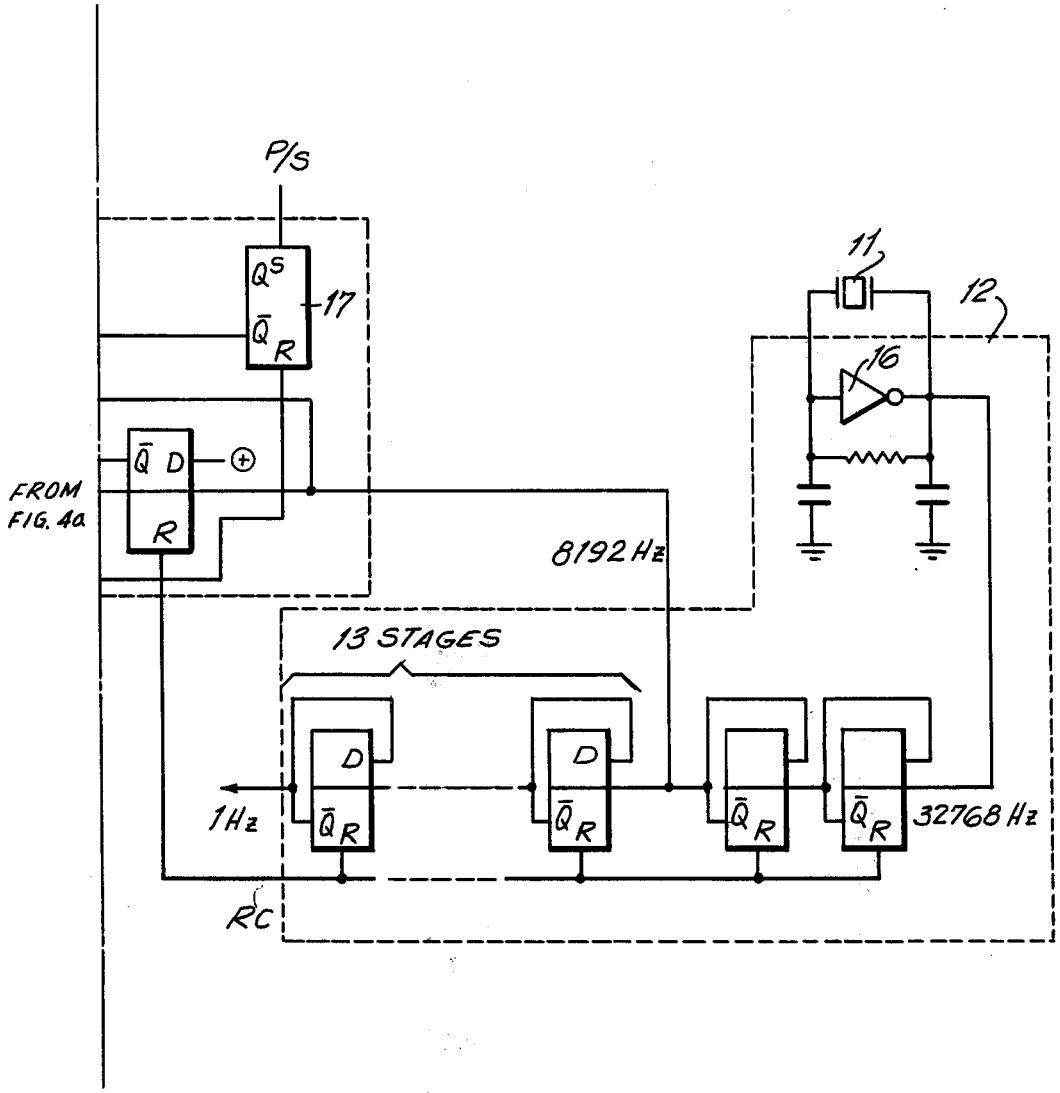

As depicted in FIG. 2, a receiver 6 is adpated to apply received pulses to a preamplifier-wave shaper circuit 7. In the preferred embodiment depicted in FIGS. 4*a* and 4*b*, the detector circuit is a detection coil antenna, for detecting magnetic pulses applied thereto. Accordingly, such coil can be made particularly sensitive by providing an iron coil therein. The preamplifier-wave shaper circuit 7 effects amplification and shaping of the waves by utilizing a plurality of C-MOS inverters. The data signals received by the receiver 6 after being amplified and shaped are applied to a storage register 8 and to an internal clock pulse generator circuit 9. A correction control circuit 10 is coupled to the preamplifier-wave shaper circuit 7 and internal clock pulse generator circuit 9 to prevent the application of data signals received unless the manually operable switch is in an unlocked position. In the preferred embodiment, a switch 19 is disposed in an open position representative of the locked position of the switch 2 in FIG. 1, the closing of the switch defining the unlocked position. Accordingly, in the embodiment depicted therein, when the switch 19 is open, thereby defining a locked position, a zero is applied through an inverter and line DR to the NOR gate which comprises the output gate of the preamplifier-wave shaper circuit 7 and thereby prevents transmission of any signals received by the detection coil 6. The correction control circuit 10 further includes a D-type flip-flop coupled to the switch 19, which flip-flop is coupled through an AND gate to the internal clock pulse generator circuit 9, the second input to said AND gate being from correction switch 19. The D-type flip-flop is gated by the output of the oscillator (32,768 Hz) so that the output of the AND gate is a narrow pulse produced for each closing switch 19. The internal clock pulse generator 9 receives an intermediate frequency signal (8,192 Hz) produced by the oscillator and divider circuit 12 and in response thereto applies a clock pulse CL to the storage register 8 in synchronization with application of the data pulses (DATA) to effect a reading of the BCD coded data pulses into the register 8. The correction control circuit 10 is additionally coupled to the counters 13 by line DR to effect resetting of the counters 13 in response to an unlocking of the correction switch 19. Such unlocking further effects an opening of the transmission NOR gate at the output of the preamplifier-wave shaper circuit 7 and a transmission of the clock pulse CL to the register 8 coincident with the application of the data signals to thereby read the received BCD coded signal into register 8. Upon completion of the information being read into register 8 a signal P/S is produced and the information stored in said register is applied to the present terminals of the flip-flops comprising the counters 13 to thereby automatically read in the information transmitted by the time standard electronic timepiece 3. Referring specifically to FIG. 3, the control pulse signal A transmitted by time standard electronic timepiece 3 and the internal clock pulse B produced the internal clock pulse generator 9 are depicted. The first pulse a in the transmitted pulse signal A is a pulse to effect synchronizing of the inner clock pulse signal B so that the group b of the information pulses of the transmitted pulse signal A can be synchronously applied to the information register 8 by utilizing the inner clock signal. Thus, a predetermined interval after the pulse a is received, a predetermined number of clock pulses are generated. In such manner, the information pulses, such as BCD code pulses are stored in the information register 8, after completion of which same are read into the respective flip-flops defining the counters 13.

With respect to a specific example, the operation of the preferred embodiment depicted in FIGS. 4*a* and 4*b* and 5*a* and 5*b* is explained below. As long as the switch 19 remains in an open-locked position, the transmitted signals are prevented from being transmitted to the information register 8 and internal clock pulse generator 9. Upon positioning the switch in a closed-unlocked position, the input terminal of the NOR gate comprising the output of the preamplifier-wave shaper circuit 7 effects opening of said gate to thereby permit transmission of the data pulses received thereby. Coincident with the unlocking of the switch 19 by the closing of same, a pulse is applied to the reset terminal of the set-reset flip-flop 18 to place the $\overline{Q}$ terminal at a 1 and effect an application of a reset pulse RC to each of the flip-flops comprising the divider circuit 12 to effect a resetting of same to 0. Additionally, reset pulse RC is also applied to each of the D-type flip-flops comprising the internal clock pulse generator circuit 9. Accordingly, after each divider stage comprising the divider circuit is reset by the pulse RC at the moment that the switch 19 is placed in an unlocked position, the first transmitted pulse A received by coil 6 is applied to the set-reset flip-flop 18 to effect a setting of same to a 1, permitting the divider stages comprising the divider circuit 12 to once again begin counting and apply the 8,192 Hz signal to the internal pulse clock generator circuit 9 and 1 Hz signal at the output of the divider one second after the divider stages are restarted in response to the first data pulse. The 8,192 Hz signal is applied as an input clock pulse for D-type flip-flops, which flip-flops are coupled to an AND gate also adapted to receive the 8,192 Hz signal through an inverter and to effect gating of same in response to the output $\overline{Q}$ of the set-reset flip-flop 17. The set-reset flip-flop 17 is reset by the pulse RC when the switch 19 is closed, thereby setting the output Q at 1 to open the output AND gate of the internal clock pulse generator 9. The 8,192 Hz signal is applied through the inverter to the AND gate and through the four-stage D-type delay flip-flops and in response to the application of four 8,192 Hz pulses to the D-type flip-flops, effects an output CL have a frequency of 8,192 Hz. The four-pulse delay is utilized for synchronizing the information received with the input clock pulse generator, but such delay is optional and can even be omitted completely if the transmitted signals are synchronous with the internal clock pulse signal.

The internal clock pulse signal CL produced by the internal clock pulse generator 9 is applied as a clock pulse input to the register 18, which register is formed of a plurality of series connected D-type flip-flops, which flip-flops operate as a shift register and include a sufficient number of stages to define the correct number of bits for re-writing the contents of the time counters 13. For the preferred embodiment depicted in FIGS. 5*a* and 5*b*, a total of 21 bits consisting of 12 bits for counting and displaying each minute digit, and hour digit in BCD signals, one bit for 10 hours and eight bits for re-writing the digits of the second and 10 second counters notwithstanding that the signals counted by same are not displayed. Moreover, the setting of the last bit to 1 coincident with the application of the 8,192 pulse CL effects a generation of a P/S signal in the form of a narrow pulse produced by the differentiation circuit formed from the last flip-flop of register 8 and an AND gate. The P/S signal effects re-writing of the information in each counter by the application of the state of the resepctive stages of the shift register into the preset terminal of the respective counter stages. The P/S signal is also applied to the set-reset flip-flop 17 to set $\overline{Q}$ output to 0 and hence inhibit the application of internal clock pulse signals CL to the shift register. Upon correction of the time display, the switch 19 is re-opened to place same in locked position, which effects the application of a reset pulse to each of the D-type flip-flops comprising the shift register along line DR to reset same to 0 with the exception of the first D-type flip-flop stage to assure production of the P/S signal during the next correction cycle. If the embodiment of FIGS. 4 and 5, every shift register and flip-flop is positively triggered, by way of example.

Figure 5A:
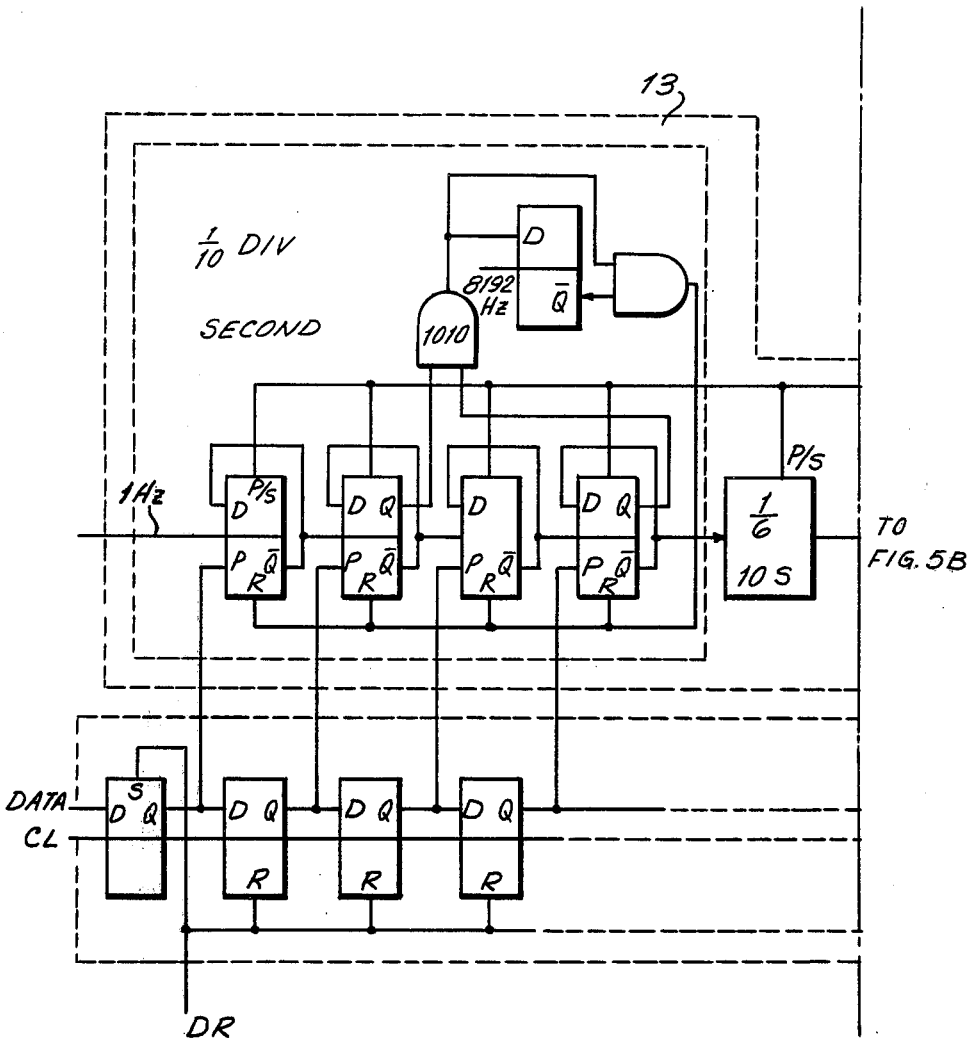
FIGS. 5*a* and 5*b* are detailed circuit diagrams of portions of the digital display electronic wristwatch depicted in FIG. 2.
Figure 5B:
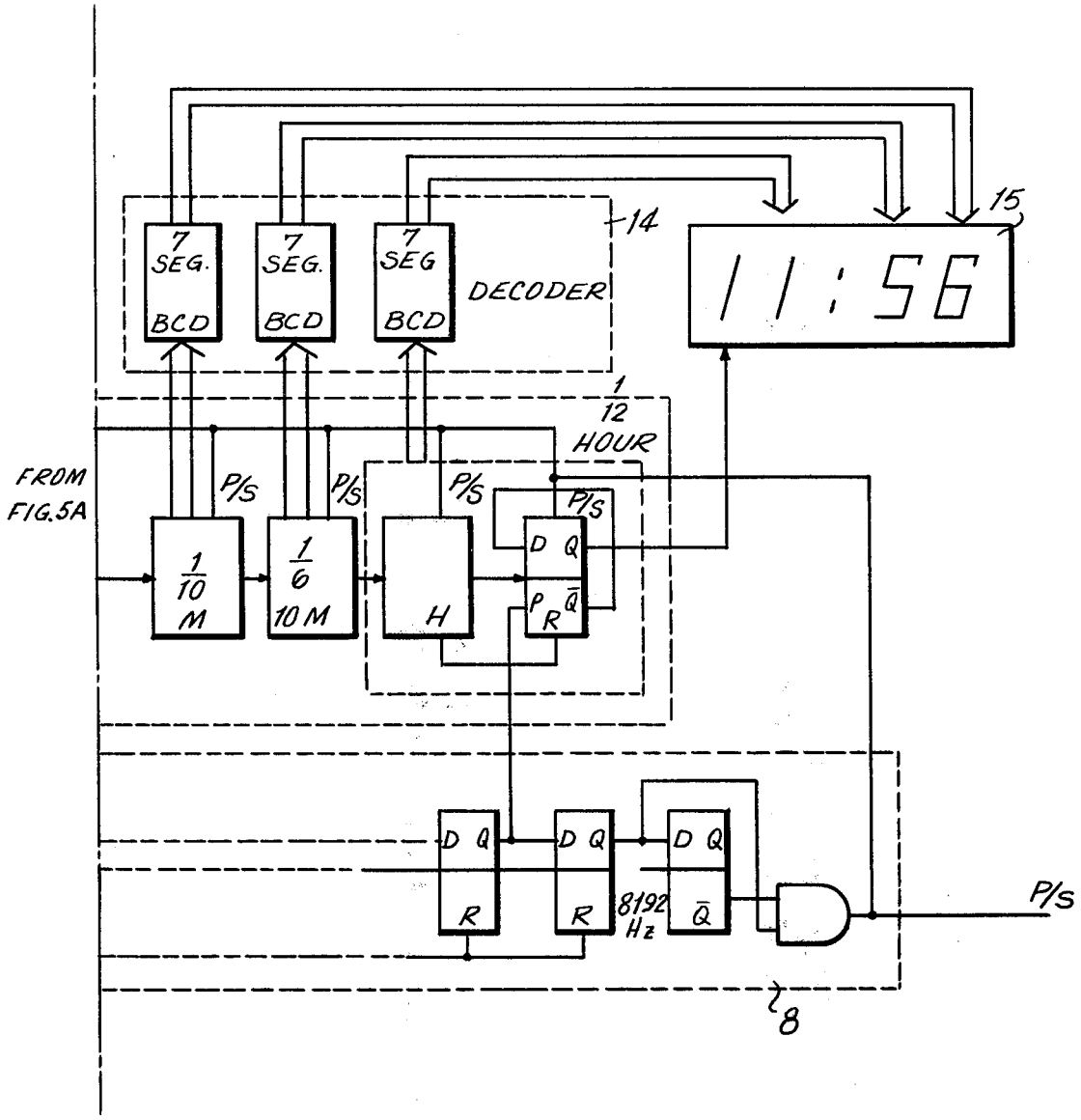

Accordingly, as depicted in detail in FIGS. 5*a* and 5*b*, each flip-flop comprising the seconds, minutes and hours counters is provided with a preset function in addition to the usual counting function to thereby permit the shift register information to be applied to the counters in response to the application of the P/S terminals receiving a pulse. Thus, a time standard electronic timepiece can transmit highly accurate signals representative of an accurate count of present time, which signals can be accurately received by an electronic wristwatch to automatically effect correction thereof in accordance with the instant invention.

It is noted that a preferred embodiment of the instant invention allows the setting pulses to be read into the shift register and upon completion of the reading in of the information, the re-writing of the information in the timepiece counters. Nevertheless, if a large number of digits of information are transmitted, or the transmission speed is slow, a pre-determined advance time may be selected and automatically added to the setting pulses to thereby read into the register 8 a time in advance of actual time, whereafter re-writing of the information is effected at the actual time. Specifically, if transmission of the information to the register takes three seconds, transmission of the signals is effected three seconds eariler than the time signals transmitted.

The instant invention is particularly suited for efficiently correcting a considerable number of electronic timepieces by utilizing a few time standard electronic timepiece transmitting devices. The transmitting electronic timepiece can also be utilized as a highly accurate clock in a residential unit or can be utilized in facilities for the mutual convenience of many owners of the electronic timepieces to be corrected. It is further noted that the correction pulses can be transmitted through telephone lines and hence would be considerably more efficient than the present method of applying a reference correction pulse at the end of each minute. Moreover, it is also possible to transmit other information in addition to the setting signal, for example, time standard information for logic regulation, the predetermined time of an electronic alarm timepiece, or the like. The quantity of data is not limited. Further, the operation of switches 2 and 5 can be automatically performed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrativve and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece assembly for automatically correcting the time display of a digital display electronic timepiece comprising in combination a first time standard electronic timepiece for accurately counting present time, said time standard electronic timepiece including transmitter means for selectively transmitting setting signals representative of the present time count of said time standard timepiece, and a further digital display electronic timepiece including timekeeping circuit means for producing timekeeping signals representative of the count thereof and digital display means for displaying time in response to said timekeeping signals, said further electronic timepiece further including receiver means for selectively receiving the setting signals representative of the count of present time transmitted by said time standard electronic timepiece transmitter means, and correction means coupled to the timekeeping means for automatically correcting the count of said timekeeping circuit means in response to the setting signals selectively received by said receiver means.

2. An electronic timepiece assembly as claimed in claim 1, wherein said timekeeping circuit means of said further electronic timepiece includes a plurality of series connected divider stages for respectively producing timekeeping signals representative of digits of time, at least a selected group of said divider stages being adapted to be preset to a selected count upon the application of a preset signal and a control signal to each of said respective stages to be preset, said correction means being adapted to store said setting signals as preset signals for application to respective divider stages, and being further adapted to produce a control signal when all of said setting signals required to preset said divider stages are stored in said correction means and apply said control signal to said divider stages to be preset to effect presetting of same to the count represented by said setting signals.

3. An electronic timepiece assembly as claimed in claim 1, wherein said time standard electronic timepiece includes operating means adapted to receive said further digital display electronic timepiece and position same proximate said time standard electronic timepiece transmitter means.

4. An electronic timepiece assembly as claimed in claim 2, wherein said further electronic timepiece includes control means adapted for selective disposition in a locking mode and in an unlocking mode, said control means being connected intermediate said receiver means and said correction means for selectively applying said setting signal to said correction means for storage therein when said control means is in its unlocking mode but preventing transmission of said setting signal to said correction means when said control means is in its locking mode.

5. An electronic timepiece assembly as claimed in claim 4, wherein said control means includes switching means for selecting between said locking and unlocking modes.

6. An electronic timepiece assembly as claimed in claim 4, wherein said switching means is a manually operated two-position switch.

7. An electronic timepiece assembly as claimed in claim 4, wherein said further electronic timepiece includes oscillator means for producing a high frequency time standard signal, said series connected divider stages being adapted to produce low frequency time keeping signals and at least one intermediate frequency signal in response to said high frequency time standard signal applied thereto, said correction means including internal clock pulse generator means for receiving said intermediate frequency signal and said setting signals, and in response thereto, produce a synchronizing signal for gating said setting signals into said correction means for storage.

8. An electronic timepiece assembly as claimed in claim 7, wherein said correction circuit means includes first circuit means for resetting said divider stages upon the switching of said control means from its locking to its unlocked mode and upon the receipt of a predetermined number of pulses of said setting signal, said internal clock pulse generator means thereafter receiving said intermediate frequency signal for production of said synchronizing signal.

9. An electronic timepiece assembly as claimed in claim 8, wherein said internal clock pulse generator means includes means for inhibiting the production of said synchronizing signal upon receipt of said control signal.

10. An electronic timepiece as claimed in claim 8, wherein said internal clock pulse generator means includes means for inhibiting the production of said synchronizing signal upon receipt of said control signal.

11. An electronic timepiece assembly as claimed in claim 3, wherein said time standard electronic timepiece operating means includes a recess for receiving and positioning said further electronic timepiece proximate said time standard electronic timepiece transmitter means.

12. A digital display electronic wristwatch adapted to have the time displayed thereby automatically corrected in response to setting signals representative of the count of present time transmitted from a remote source comprising timekeeping circuit means including a plurality of series-connected divider stages for respectively producing timekeeping signals representative of the count thereof, digital display means for displaying time in response to said timekeeping signals, receiver means for selectively said setting signals, and correction means coupled to a selected group of said divider stages for automatically correcting the count of said divider stages to the count of present time in response to the setting signals transmitted by the remote source being selectively received by the receiver means.

13. An electronic timepiece assembly as claimed in claim 12, wherein said selected group of said divider stages is adapted to be preset to a selected count upon the application of a preset signal and a control signal to each of said respective stages to be preset, said correction means being adapted to store said setting signals as preset signals for application to respective divider stages and being further adapted to produce a control signal when all of said setting signals required to preset said divider stage are stored in said correction means and apply said control signal to said divider stages to be preset to effect presetting of same to the count represented by said setting signals.

14. An electronic timepiece as claimed in claim 13, and including control means adapted for selective disposition in a locking mode and in an unlocking mode, said control means being connected intermediate said receiver means and said correction means for selectively applying said setting signals to said correction means for storage therein when said control means is disposed in an unlocking mode but preventing transmission of said setting signal to said correction means when said control means is disposed in said locking mode.

15. An electronic timepiece as claimed in claim 14, wherein said control means includes switching means for selecting between said locking and unlocking modes.

16. An electronic timepiece as claimed in claim 14, and including oscillator means for producing a high frequency time standard signal, said series-connected divider stages being adapted to produce low frequency timekeeping signals and at least one intermediate frequency signal in response to said high frequency time standard signal applied thereto, said correction means including internal clock pulse generator means for receiving said intermediate frequency signal and said setting signals, and in response thereto, producing a synchronizing signal for gating said setting signals into said correction means for storage.

17. An electronic timepiece assembly as claimed in claim 16, wherein said correction circuit means includes first circuit means for resetting said divider stages upon the switching of said control means from said locked to said unlocked mode and upon receipt of a predetermined number of pulses of said setting signal, said internal clock pulse generator means thereafter receiving said intermediate frequency signal for production of said synchronizing signal.

* * * * *